United States Patent [19]

Blehert

[11] Patent Number: 4,580,313

[45] Date of Patent: Apr. 8, 1986

[54] WALK BEHIND FLOOR MAINTENANCE MACHINE

[75] Inventor: Michael L. Blehert, Crystal, Minn.

[73] Assignee: Tennant Company, Minneapolis, Minn.

[21] Appl. No.: 531,456

[22] Filed: Sep. 12, 1983

[51] Int. Cl.[4] ..... A47L 11/24

[52] U.S. Cl. ..... 15/349; 15/79 A; 15/83; 15/352

[58] Field of Search ..... 15/348, 349, 352, 83; 55/295, 300

[56] References Cited

U.S. PATENT DOCUMENTS

| | | | |
|---|---|---|---|
| 2,701,377 | 2/1955 | Luksch et al. | 15/349 X |
| 2,739,340 | 3/1956 | Blydenburgh et al. | 15/349 |
| 2,972,159 | 2/1961 | Swanson et al. | 15/83 X |
| 3,160,908 | 12/1964 | Peabody et al. | 15/352 X |
| 3,233,274 | 2/1966 | Kroll | 15/349 X |
| 3,639,940 | 2/1972 | Carlson et al. | 15/349 X |
| 3,747,156 | 7/1973 | Carlson et al. | 15/349 |
| 3,792,569 | 2/1974 | Carlson et al. | 55/288 |
| 3,847,576 | 11/1974 | Oberdank | 55/283 |
| 3,918,118 | 11/1975 | vom Berg et al. | 15/83 |
| 4,007,026 | 2/1977 | Groh | 15/352 X |
| 4,032,307 | 6/1977 | Sommerfeld | 55/96 |
| 4,173,052 | 11/1979 | Burgoon et al. | 15/349 X |
| 4,258,451 | 3/1981 | Sommerfeld | 15/352 |
| 4,328,014 | 5/1982 | Burgoon et al. | 55/300 |
| 4,345,353 | 8/1982 | Sommerfeld | 15/349 |
| 4,459,719 | 7/1984 | Notestine | 15/349 |

OTHER PUBLICATIONS

Brochure entitled "The Self-Propelled Battery Retriever 360-B. One Easy Way to End Tough Litter Problems", Industrial Division, Advance Floor Machine Company, Spring Park, Minn.

Brochure entitled "Wayne Industrial Sweepers, Model 836", FMC Corporation, Municipal & Industrial Service Equipment Division, Pomona, Calif.

Brochure entitled "Wayne Starsweep Series/500 Walker Type Power Sweepers, See Them! Try Them! Compare Them!", Wayne Manufacturing Co., Chicago, Ill.

Brochure entitled "Clarke Space Sweeper".

Brochure entitled "Staubfreie Innenund AuBenreinigung? Problem Gelost Mit Der Kehrsaugmaschine Hako-Hamster", Hako.

Brouchure entitled "Tennant 220 Power Sweeper", Tennant Company, Minneapolis, Minn.

Brochure entitled "92 Power Sweeper", Tennant Company, Minneapolis, Minn.

*Primary Examiner*—Chris K. Moore

*Attorney, Agent, or Firm*—Kinzer, Plyer, Dorn & McEachran

[57] ABSTRACT

A walk behind floor maintenance machine is disclosed including a filter and filter housing that may be pivoted away to permit removal of the debris hopper. The filter may be cleaned by vibrating the filter and filter housing. Dust vibrated from the filter slides into the hopper. The hopper may be manually removed for emptying.

22 Claims, 12 Drawing Figures

FIG. I
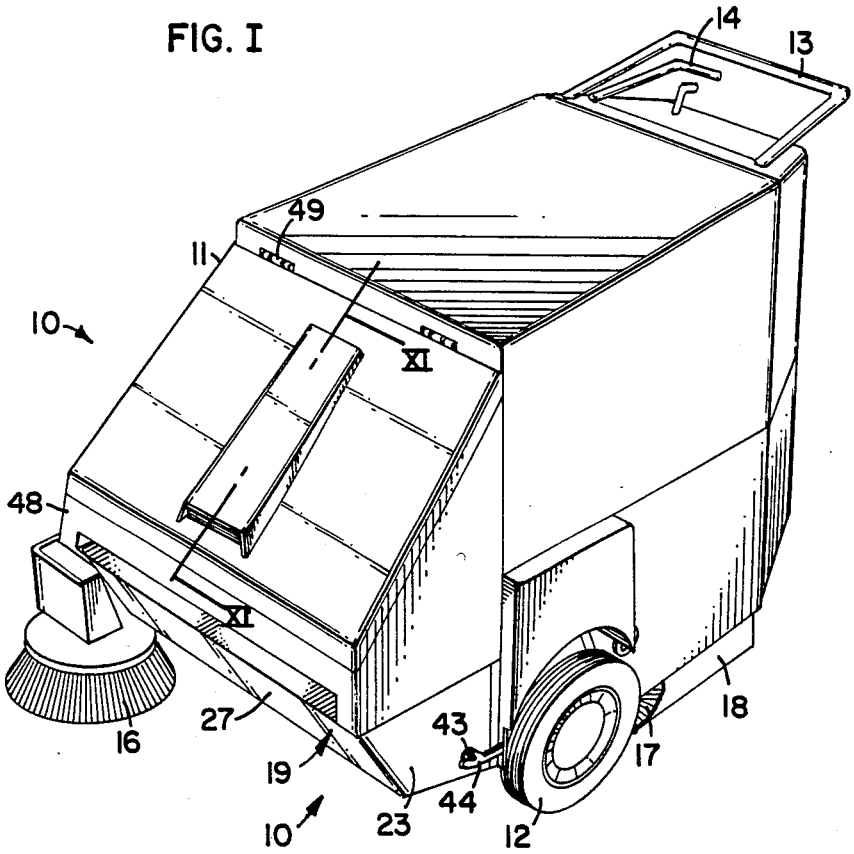
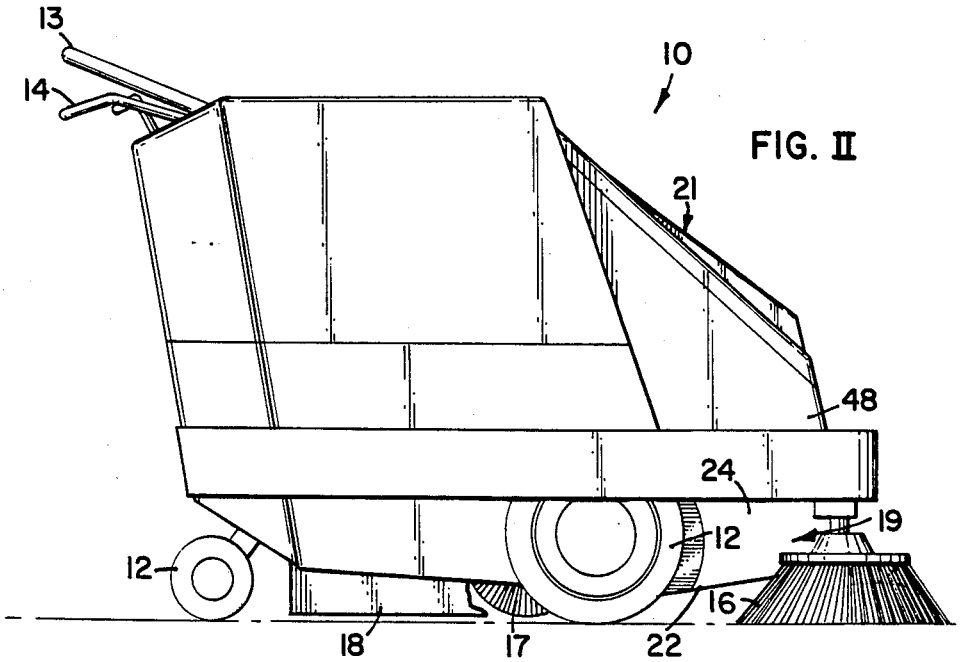
FIG. II

FIG. III
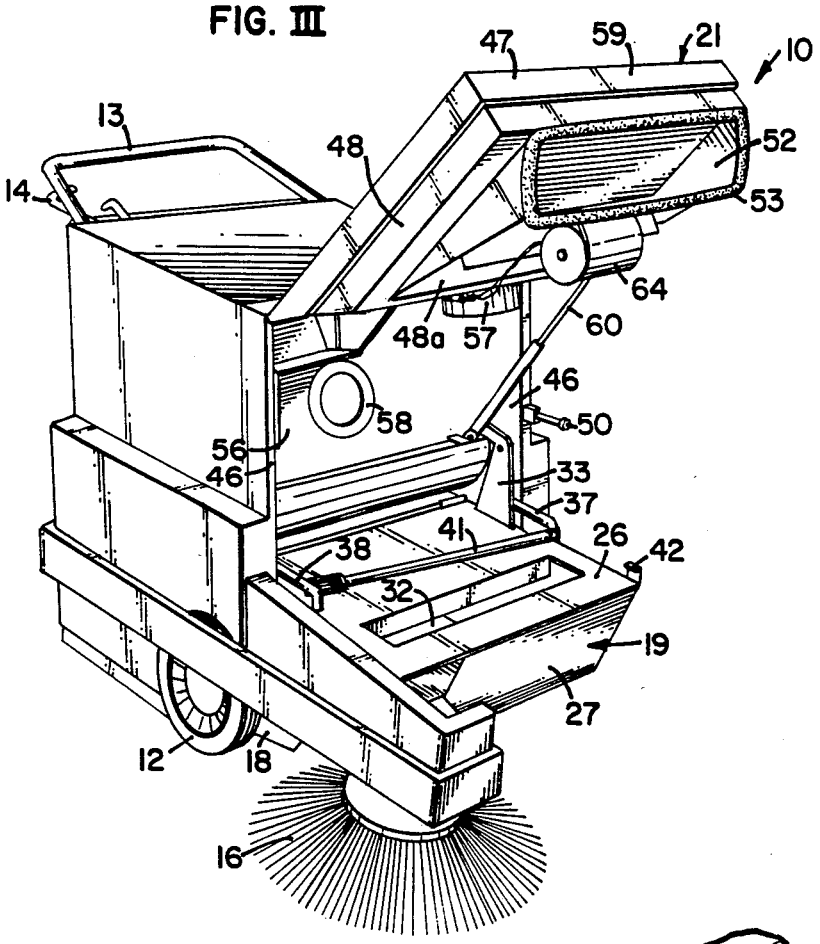
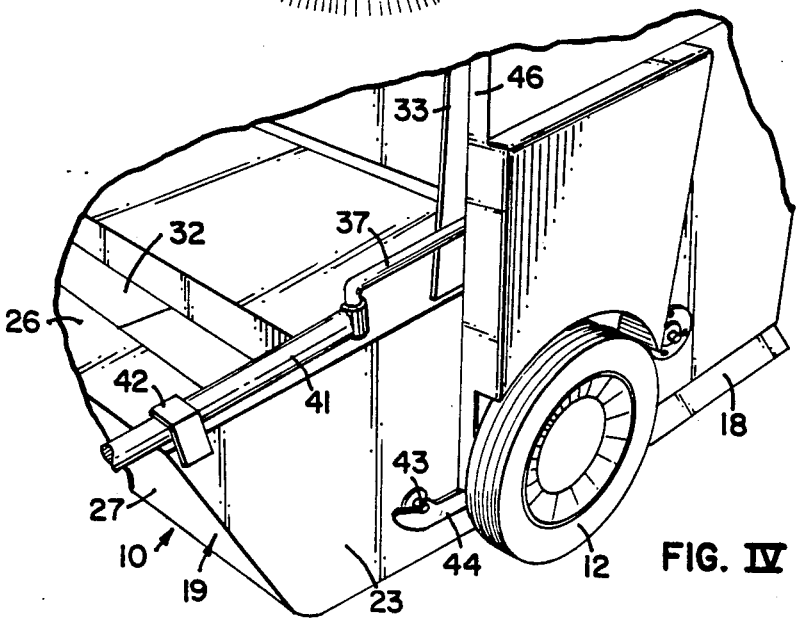
FIG. IV

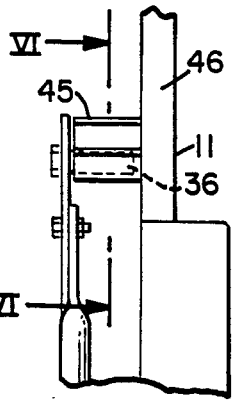
FIG. V
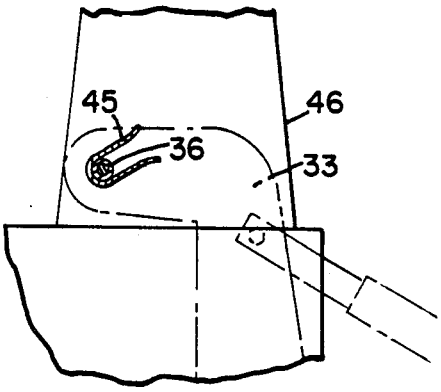
FIG. VI
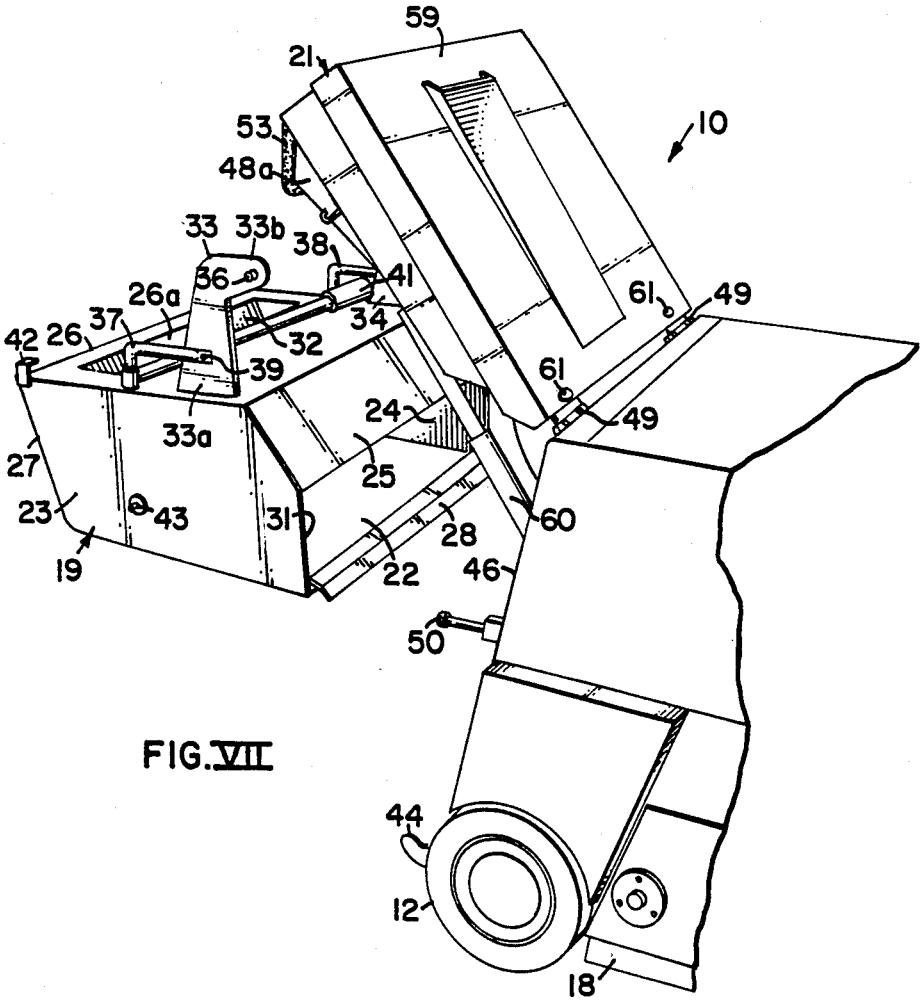
FIG. VII

FIG. VIII
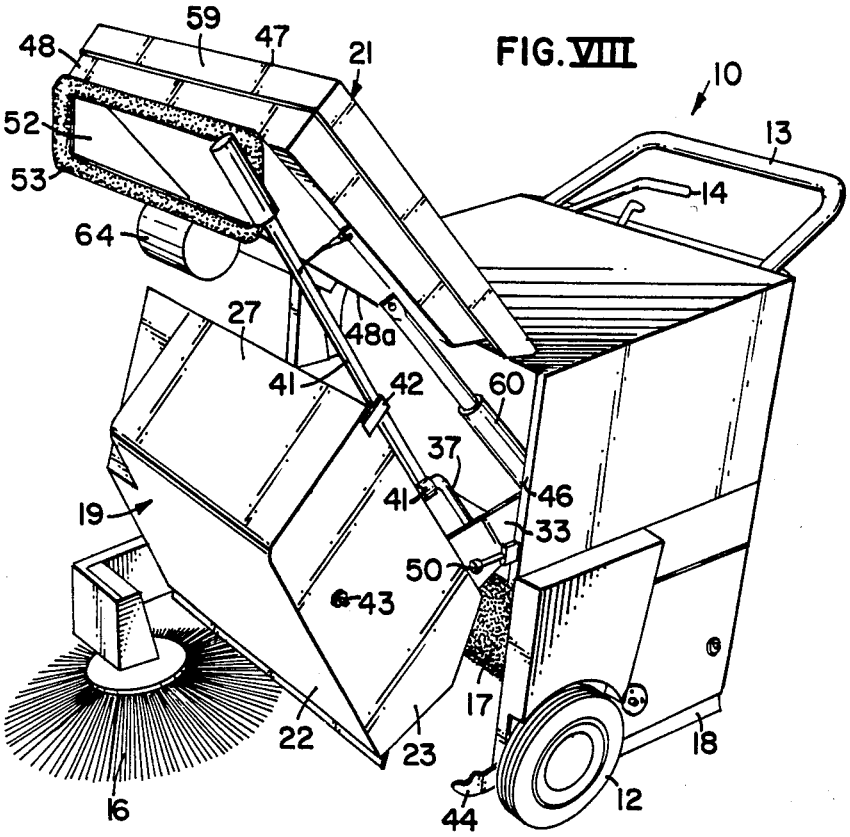
FIG. IX
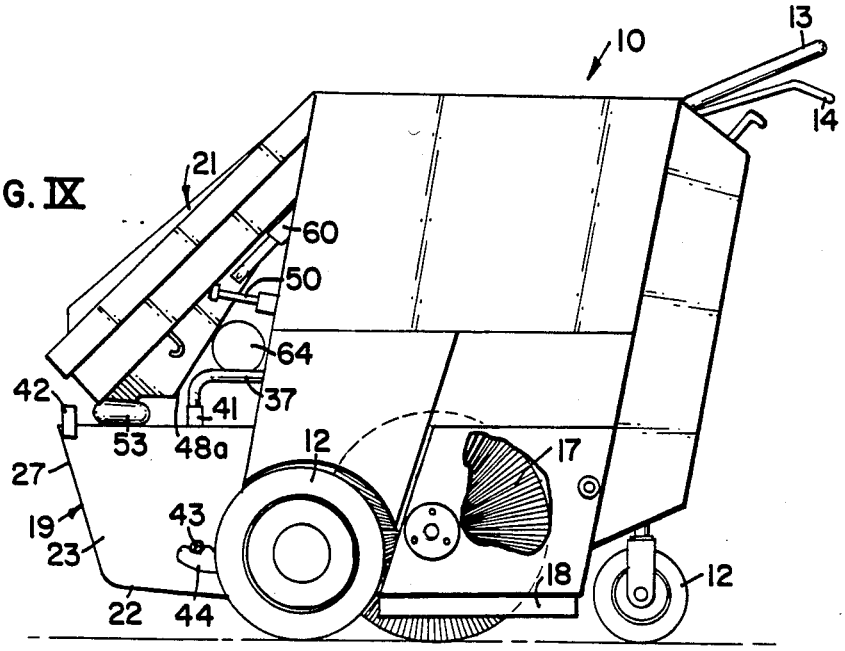

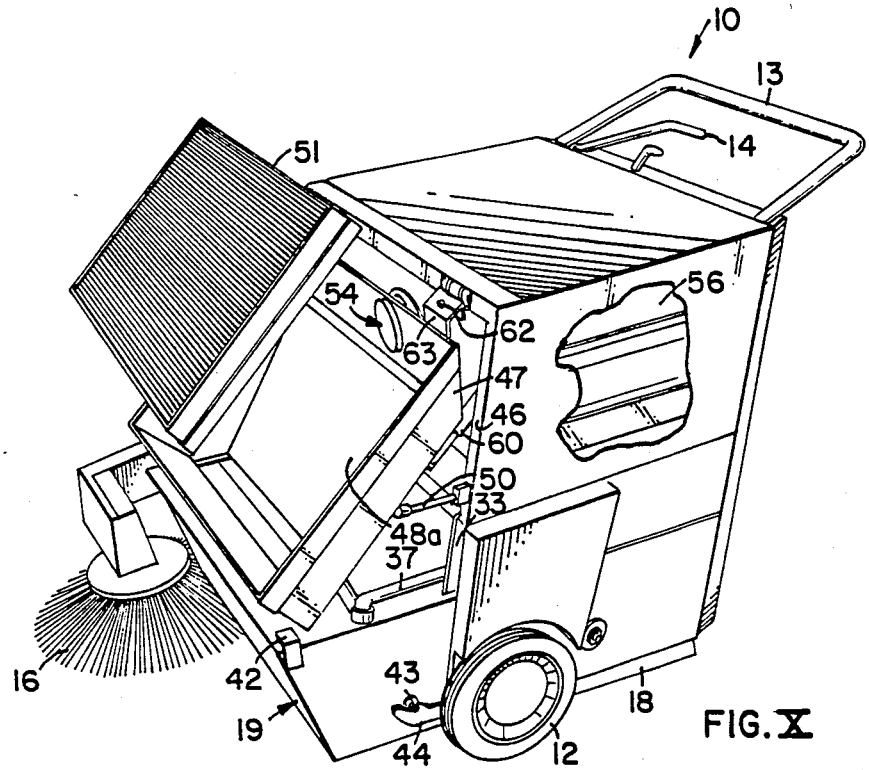
FIG. X
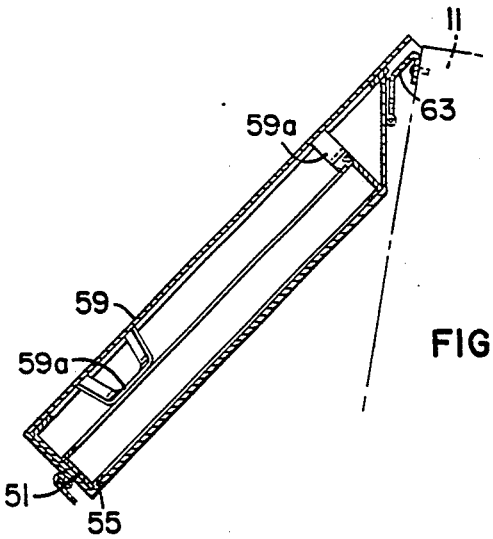
FIG. XI
FIG. XII
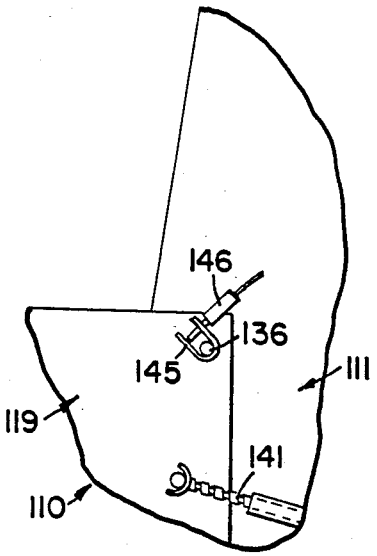

WALK BEHIND FLOOR MAINTENANCE MACHINE

TECHNICAL FIELD

The present invention relates to surface maintenance equipment and more particularly to walk behind surface maintenance equipment utilizing a fan for drawing a vacuum airstream through such equipment. The present invention further relates to such equipment including a filter for removing dust from such stream prior to passage through the fan.

BACKGROUND OF THE INVENTION

A wide variety of machines have been available in the past for use in maintenance of surfaces such as floors, parking lots, and the like. Such maintenance machines include self-propelled riding machines as well as self-propelled walk behind machines. Typically, both types of machines have utilized fans or pumps to draw a vacuum in the brush housing thereby minimizing dusting around the brush housing. Filters have generally been provided to minimize the amount of dust that passes through the fan. In the absence of such filters, the dust causes unnecessary wear and degradation of the fan and pollutes the atmosphere. A long-standing problem has been the accumulation of dust on the filter. This tends to block the filter and create a substantial pressure differential between the upstream side of the filter and the downstream side of the filter, thus reducing the efficiency of the equipment. A manual or mechanical system is generally incorporated to clean the filter at regular intervals to enable the machine to continue to function without frequent replacement of the filter.

Walk behind units desirably are of a small size and thus large powered hopper dumping elements have not been provided. Some walk behind units have included a hopper that may be manually lifted by the operator, carried to a suitable location and dumped. Such units in the past have, of necessity, spaced the filter from the hopper to permit removal of the hopper. Such spacing, of course, does not provide for a minimized size of unit. Further, such spacing does not provide for return of the dust from the filter to the hopper. Instead, such units have generally included a secondary hopper or drawer into which accumulated dust is dropped.

SUMMARY OF THE PRESENT INVENTION

The present invention provides a walk behind, power driven floor maintenance machine including a hopper, a cylindrical driven brush for moving soilage into the hopper, a vacuum fan for drawing an airstream through the hopper and a filter for removing dust particles from the airstream before exhausting to the atmosphere. The present machine has a filter disposed in a filter housing. The filter housing is box-like in shape and is disposed immediately above the hopper. The filter housing is sloped downwardly and forwardly to communicate at its forward end with the hopper. The filter housing is hingedly secured at its upper end to the body of the floor maintenance machine and is freely but sealingly engaged at its lower end with the hopper. The filter housing may be vibrated to shake collected dust from the filter and to convey such dust along the sloped lower wall of the housing into the hopper. Thus the lower wall serves as a vibratory conveyor. The filter housing may be pivoted upwardly out of the way when one desires to remove the hopper such as for dumping.

BRIEF DESCRIPTION OF THE DRAWINGS

FIG. I is a perspective view from the left front of the present invention;

FIG. II is a side elevational view of the embodiment of FIG. I;

FIG. III is a perspective view of the present invention with the filter housing pivoted to its uppermost position;

FIG. IV shows a lower front portion of the invention including a hopper support member;

FIGS. V and VI show the upper side supports of the hopper;

FIG. VII shows the present invention with the filter housing pivoted to its uppermost position and the hopper lifted out of its supported position;

FIG. VIII shows the present invention with the hopper pivoted to a dumping position;

FIG. IX shows a side view of the present invention with housing portions removed to expose underlying structure;

FIG. X is an exploded view of the filter assembly on the present floor maintenance machine.

FIG. XI is a cross sectional view of the filter assembly; and

FIG. XII is a schematic view of an alternate embodiment.

DETAILED DESCRIPTION OF THE PREFERRED EMBODIMENT

The present invention, as illustrated in FIGS. I–XI relates to surface maintenance equipment and more specifically to equipment commonly referred to as sweepers. The sweeper 10 includes a body portion 11 supported on a plurality of wheels 12. The body 11 has controls such as the steering bar 13 and shifting lever 14. A side brush 16 may be disposed at the forward portion of sweeper 10. The sweeper 10 of course includes a housing which overlies the internal structural portions of the machine. The present machine 10 has a rotatably driven cylindrical brush 17 which may be encased within a suitable dust housing 18 which minimizes dusting around the machine.

The present invention is illustrated in FIG. III with various housing portions removed to disclose the underlying structure, including hopper 19 and filter housing 21. As shown in FIGS. III, IV and VII, the hopper includes a bottom wall 22, a pair of sidewalls 23 and 24, an upper wall 26 and a front wall 27. The bottom wall 22 may include a ramp 28, for example, of a resilient elastomeric material. If desired, the hopper 19 may be partially enclosed to the rear by wall 25 thus providing an opening 31 for receipt of swept material. The upper wall 26 has a rectangular opening 32 therein for purposes hereinafter described. A pair of upwardly extending arms 33 and 34 may be mounted on the upper wall 26. The arms 33 and 34 are mirror images of each other; however, otherwise they may be identical in structure. Arm 33, for example, may include an upwardly extending portion **33*a* and a rearwardly extending portion 33*b*. Portion 33*b* has an outwardly extending stub shaft 36 which assists in supporting the hopper with respect to the body 11. Arm 34 is similarly constructed. A pair of L-shaped bars 37 and 38 serve as suitable handles for lifting and carrying the hopper 19. Bar 37, for example, may be welded at one end to upper wall 26 and secured by a bolt 39 at the other end. The hopper 19 has a lever and grip 41 rotatably secured at one end to the bar 37. The lever and grip 41 may be of a length slightly less than the width of the hopper 19 to permit stowing. The lever 41 may be rotated from the position shown in FIG. VII to the position shown in FIG. VIII. A small angle member or lock 42 secures handle 41** when rotated to the position shown in FIG. VIII.

The hopper sidewalls 23 and 24 each have an outwardly extending stub shaft 43. The stub shafts 36 and 43 serve to support the hopper 19 with respect to the body 11. The stub shaft 36 is located rearwardly of the center of mass of hopper 19 whereas the stub shaft 43 is located slightly forwardly of the center mass. The body 11 has a forwardly extending arm 44 adjacent each side for supporting engagement with the stub shaft 43. The arm 44 as illustrated in FIG. X may have an upwardly facing recess in which the stub shaft 43 is held. The body 11 (FIGS. V and VI) has a pair of side members 46, one on either side, on which is located a channel-like support 45 for reception of the stub shaft 36.

The filter assembly 21 as illustrated in FIGS. III, VII and IX, includes a housing 47 having a lower portion 48 and cover 59. Housing 47 is supported with respect to the body 11 by hinges 49 (FIG. VII) and by stop 50. A panel filter 51 (FIG. X) is supported in the housing 47 and sealed with respect to such housing such that any air passing through the housing 47 must pass through the filter. The filter thus divides the housing into a dusty air zone beneath the filter and a clean air zone above the filter. The housing 47 (FIGS. VII, VIII and X) has an inlet 52 with a suitable resilient seal 53 therearound. The inlet 52 mates with hopper opening 32 to receive air from the hopper. The housing 47 (FIGS. III and X) further includes an outlet 54 which communicates with a vacuum fan 56. The outlet 54 may include a short tube 57 which slides into a rubber boot 58 when the filter housing is in the lowered operating position, and yet slips out of such boot when the housing is raised, as illustrated in FIG. III. The filter housing 47 has a cover portion 59 which may be removed by the removal of screws 61 (FIGS. VII and X) from the threaded openings 62 in the housing support brackets 63. Panel filter 51 may be then lifted out and removed.

Although a specific embodiment of the present invention has been disclosed, it is to be recognized that a wide variety of modifications may be made within the scope of the present invention. For example, the present invention is illustrated using a panel filter however other types of filters may be used such as bag filters, canister filters and the like. Further, the tube 57 and boot 58 may be replaced with an accordion-type tube which is secured at one end to a fan duct and secured at the other end to the filter housing 47.

In a preferred embodiment of the present invention (FIG. III), an electrically powered eccentric weight device 64 is provided to vibrate the entire housing 47 and panel filter 51. Since the device 64 is located outside the filter housing 47 it is protected from the abrasive, dusty environment of such housing and thus has an extended life. In the absence of such a vibrating device, the housing and filter may be vibrated by merely striking the housing with one's fist to dislodge dust from the filter. The lower wall 48*a* of housing 47 may slope downwardly and may act as a vibratory conveyor to move the dislodged dust to the hopper.

OPERATION OF THE INVENTION

Although operation of the present invention would be apparent from the above description, it will be further described hereinafter to provide a more complete understanding of the advantages of the present invention.

In general operation, the present invention has many aspects which are common to most walk behind sweepers and further has aspects and advantages which are totally new. As with many walk behind sweepers in the past, the present sweeper is powered by any suitable power source, such as an electric motor or a gasoline powered engine. The power source drives the wheels 12 and the brushes 16 and 17. The brush 16 serves to sweep dirt and debris from the side of the sweeper path into the center portion where the main brush 17 picks up the dirt and debris, sweeping it into the hopper 19. The dirt and debris enters the hopper opening 31 and generally is retained therein. A vacuum fan 56 serves to draw an airstream through the hopper 19 moving light debris forwardly. The filter assembly 21 serves to remove dust-laden air from the airstream, thus protecting the fan motor 56 from abrasion. This also protects the operator from breathing dust-laden air. The panel filter 51 serves to trap such dust. During normal operation, the filter assembly 21 engages at its lower end the hopper 19 with the opening 52 of assembly 2 communicating with the opening 32 of hopper 19. The weight of the filter assembly 21 is supported on stop 50. The resilient seal 53 prevents entrance of ambient air, thus requiring all airstream to pass through the hopper. One may activate the eccentric vibrator 64 periodically to shake the dust collected from panel filter 51. The lower wall of the filter housing 47 is also vibrated and the dust slides therealong to drop into the hopper 19. If one wishes to replace the panel filter 51, screws 61 are removed and the cover 59 is removed providing access to such filter.

When the operator desires to empty the hopper 19 of collected dirt and debris, the filter assembly 21 is pivoted upwardly as shown in FIG. III. To facilitate this operation, an air spring 60 may be provided to counterbalance the weight of such assembly. Alternatively, suitable releasable bracing may be provided. The operator may grasp the handles 37 and 38 and lift the hopper 19 from its position on sweeper 10. The hopper may be carried to a suitable dump area and emptied. Alternatively, if the operator merely wishes to dump the hopper 19 at the location of the sweeper 10, the handle 41 may be pivoted to the position shown in FIG. IV and the hopper elevated to the position shown in FIG. VIII with the hopper pivoting on the stub shaft 36. The pair of stub shaft supports 43 at each side of hopper 19 permit the hopper to rock over obstacles. For example, as an obstacle such as a can or brick moves beneath the rear portion of hopper 19 and resilient lip 28, the hopper 19 may pivot upwardly resting on shafts 43.

ALTERNATE EMBODIMENT

An alternate embodiment of the present invention, sweeper 110, is illustrated in FIG. XII. Sweeper 110 may be identical in structure except that sweeper 110 includes a power dump for the hopper 119. The power dump may be an electrically driven screw 141 which is mounted on sweeper body 111. The screw 141 acts to rotate hopper 119 in a clockwise direction as viewed in FIG. XII to an elevated dump position. The upper stub shafts 136 may be locked in channel 145 by a solenoid 146 but only during the dumping operation. The sweeper 110 of course has suitable controls for activating the solenoid 146 and the screw 141 for dumping. The sweeper 110 may include a lockout mechanism which prevents activation of screw 141 unless the operator has first raised the filter housing 121. The operator may, if desired, manually lift and carry the hopper 119 to a dump site.

What is claimed is:

1. A floor maintenance machine comprising a body portion supported on a plurality of wheels, said body portion carrying a rotatably driven brush and a removal hopper, said brush being adapted to sweep debris into said hopper, said body further carrying a fan for drawing an airstream through said hopper and providing a partial vacuum in the zone surrounding said brush to prevent dusting, said body portion further carrying a filter housing with a filter therein for removing dust particles from said airstream prior to entrance into said fan, the filter housing being located above the hopper, the filter housing comprising an elongated box-like structure hingedly mounted to the body portion adjacent the upper end of the housing, an opening between the hopper and filter housing to provide for air flow from the hopper to the filter housing, said filter housing having a lower sloped wall and means for vibrating said filter to dislodge adhered dust particles from said filter, the lower sloping wall being disposed relative to the opening between the hopper and filter housing such that substantially all of said dislodged particles that fall onto and slide along said sloped wall fall through the opening into said hopper.

2. The floor maintenance machine of claim 1 further characterized in that the filter housing is provided with an annular seal around the opening which connects the filter housing and hopper for air flow between them, the filter housing being movable on the machine relative to the hopper so that when the hopper and filter housing are brought together the seal will form an airtight joint between them.

3. The floor maintenance machine of claim 2 wherein said seal means comprise a compressible seal adapted to permit relative movement between said hopper and said filter housing while still maintaining a sealed relationship between the hopper and the filter housing.

4. In a sweeper, a mobile frame, a cylindrical brush on the frame for propelling debris from a surface to be cleaned, a removably mounted hopper in an operative location on the frame with an opening therein for receiving and collecting debris propelled by the brush, a filter unit on the frame, a vacuum system on the frame adapted to create an air current through the hopper and filter unit to draw dust created by the brush through the hopper into the filter unit, and means for mounting the hopper on the frame so that it may be either removed from the frame for manual dumping or may be moved on the frame while at its operative location to a position in which the hopper is in a dumping disposition with the opening therein facing downwardly so that the collected debris in the hopper will fall by gravity back through the opening.

5. The structure of claim 4 further characterized in that the hopper is capable of being manually moved to a dumping position on the frame with the opening therein facing downwardly.

6. The structure of claim 5 further characterized in that the hopper is pivoted about an axis on the frame to its dumping position.

7. In a sweeping machine, a mobile frame, a main cylindrical brush on the frame for propelling material from a surface to be cleaned, a debris hopper mounted on the frame with an inlet opening for receiving debris propelled by the brush, the hopper being movably mounted on the frame so that it can be moved for dumping, a movably mounted filter housing with a filter therein mounted directly on the frame above the hopper and constructed and arranged to be moved on the frame between an operative position where it engages the hopper and an inoperative position where it is remote from the hopper so that the hopper may be moved and dumped, and a vacuum system on the frame to create an air current through the hopper and filter housing to prevent dusting when the hopper and filter housing are in operative position for sweeping.

8. The structure of claim 7 further characterized in that the filter housing is pivotally mounted on the frame so that it may be pivoted up to its inoperative position and pivoted down to its operative position.

9. The structure of claim 7 in which the hopper is pivoted on the frame so that it may be moved to a position in which the inlet opening is disposed downwardly for dumping.

10. The structure of claim 7 further characterized in that the hopper can be completely removed from the frame.

11. In a sweeping machine, a mobile frame, a main cylindrical brush on the frame for propelling debris from a surface to be cleaned, a hopper on the frame with an opening therein disposed to receive and collect debris propelled by the brush, a filter housing with a filter element therein connected to the hopper, a vacuum fan on the frame adapted to create an air current through the filter housing and hopper to draw dust created by the brush through the hopper and filter housing to prevent dusting, and a vibrator mounted on the outside of the filter housing so that it is not in the air current created by the vacuum fan and is connected to the filter housing so as to vibrate the filter housing and the filter element therein to cause dust collected on the filter element to be dislodged.

12. The structure of claim 11 in which the filter housing is above the hopper with an opening between them constructed and arranged so that when dust is dislodged from the filter element by the vibrator, it will automatically fall through the opening into the hopper.

13. In a sweeping machine, a frame, a cylindrical brush on the frame for propelling debris from a surface to be cleaned, a removably mounted hopper in an operative location on the frame for receiving debris propelled by the brush, a filter on the frame, a vacuum fan on the frame for creating an airstream through the hopper and filter to eliminate dusting, and a separable mounting for the hopper including means defining two separate pivot axes so that the hopper will pivot to allow large debris to pass under it, may be pivoted on the frame while at its operative location to dump without removal from the frame and also may be removed from the frame for dumping.

14. The structure of claim 13 further characterized in that one pivot axis is forward of the hopper center of mass and another is rearward of the hopper center of mass in the direction of travel of the sweeper.

15. The structure of claim 14 further characterized in that the rear pivot axis is at a higher level than the forward pivot.

16. The structure of claim 13 further characterized in that each of the pivot defining means includes a pair of shafts on the hopper operatively associated with a somewhat upwardly opening pair of channels on the frame of the machine.

17. In a mobile sweeping machine, a mobile frame, a cylindrical brush on the frame for propelling debris from a surface to be cleaned, a hopper on the frame with an opening therein associated with the brush for receiving and collecting debris propelled by the brush, a mounting between the hopper and frame of the machine so that the hopper is movable between an operative position for receiving debris and a dumping position, a movably mounted filter housing on the frame with a filter therein above the hopper constructed and arranged to be moved between an operative position where it engages the hopper and an inoperative position where it is remote from the hopper, openings in the hopper and filter housing which are aligned when they are in their operative positions, a vacuum fan on the frame adapted to create an air current through the filter housing and hopper through the aligned openings to draw dust therethrough to prevent dusting, a seal around the aligned openings between the filter housing and hopper, and a stop mechanism on the frame preset to engage the filter housing to provide a predetermined sealing contact at the seal between the filter housing and hopper when the hopper and filter housing are in their operative positions.

18. The structure of claim 17 in which the seal is mounted on the filter housing and engages the debris hopper when the filter housing and debris hopper are in operative position.

19. The structure of claim 17 further characterized in that the mounting between the hopper and frame of the machine is a floating mounting so that the hopper will rock to allow large objects to pass underneath, and further characterized in that the stop mechanism determines a predetermined sealing contact of the sealing element between the hopper and filter housing such that the hopper is allowed to rock during normal operation to let large objects pass underneath.

20. In a surface sweeping machine, a mobile frame, a main cylindrical brush on the frame for sweeping debris from a surface to be cleaned, a vacuum system on the frame for creating an air current through the machine, a hopper on the frame with an inlet opening therein for receiving debris swept up by the cylindrical brush and arranged in the air current created by the vacuum system, a filter in a housing on the frame in the air current after the debris hopper constructed to remove dust particles from the air current, a floating mounting for the hopper on the frame including two pairs of disconnectable pivots, one of each pair being on each side of the hopper, the pairs being on opposite sides of the hopper's center of mass with one pair forward of the other pair in the direction of travel of the machine, and a lever on the hopper constructed and arranged to be moved between an extended position and an inoperative position so as to be used with a mechanical advantage when in its extended position to rotate and dump the hopper.

21. The structure of claim 20 wherein the lever is so constructed that it is stowable within the confines of the machine when not in use.

22. The structure of claim 20 further characterized in that the lever is attached to and foldable on the hopper to be moved between an inoperative position where it is stored and an operative position where it may be used.

* * * * *